US010477981B2

(12) United States Patent
Burns et al.

(10) Patent No.: US 10,477,981 B2
(45) Date of Patent: Nov. 19, 2019

(54) DEPTH-ADJUSTABLE FABRIC ENCLOSURE

(71) Applicant: KIDS II, INC., Atlanta, GA (US)

(72) Inventors: Stephen R. Burns, Cumming, GA (US); Jacob Sclare, Dacula, GA (US); Yuk Tong Poon, Yuen Long (HK)

(73) Assignee: KIDS2, INC., Atlanta, GA (US)

( * ) Notice: Subject to any disclaimer, the term of this patent is extended or adjusted under 35 U.S.C. 154(b) by 453 days.

(21) Appl. No.: 15/134,710

(22) Filed: Apr. 21, 2016

(65) Prior Publication Data

US 2016/0309914 A1 Oct. 27, 2016

Related U.S. Application Data

(60) Provisional application No. 62/152,845, filed on Apr. 25, 2015, provisional application No. 62/215,943, filed on Sep. 9, 2015.

(51) Int. Cl.

| | |
|---|---|
| ***A47D 7/00*** | (2006.01) |
| ***A47D 1/00*** | (2006.01) |
| ***A47D 13/10*** | (2006.01) |
| ***A47B 13/16*** | (2006.01) |

(52) U.S. Cl.

CPC ..... *A47D 1/0085* (2017.05); *A47B 13/16* (2013.01); *A47D 1/008* (2013.01); *A47D 13/105* (2013.01)

(58) Field of Classification Search

CPC ..... A47D 13/063
USPC ..... 5/93.1, 98.1, 101–102
See application file for complete search history.

(56) References Cited

U.S. PATENT DOCUMENTS

| | | | |
|---|---|---|---|
| 81,757 | A | 9/1868 | Delano |
| 548,901 | A | 10/1895 | Welch |
| 884,509 | A | 4/1908 | Lindsey |
| 909,113 | A | 1/1909 | Philia et al. |
| 1,183,819 | A | 5/1916 | Keiser |
| 1,374,333 | A | 4/1921 | Stotler et al. |
| 1,574,226 | A | 2/1926 | Ackermann |
| 1,618,493 | A | 2/1927 | Thiele |

(Continued)

FOREIGN PATENT DOCUMENTS

| | | |
|---|---|---|
| AU | 715883 | 2/2000 |
| GB | 1360375 | 7/1974 |

OTHER PUBLICATIONS

Keder—An Education on it's Design & Use; J & J Carter Limited; 2013; 6 pgs.

(Continued)

*Primary Examiner* — Fredrick C Conley
(74) *Attorney, Agent, or Firm* — Gardner Groff & Greenwald, PC

(57) ABSTRACT

A depth-adjustable fabric liner for removable attachment to a structural support fame for use as a child containment device. In example forms, the depth-adjustable fabric liner provides for adjustability to the depth of the floor or bottom of the liner such that the bottom or floor portion of the liner is adjustable between at least two different heights. In example forms, the depth-adjustable fabric liner is adjustable relative to the structural support frame between a first floor position, a second floor position, and a third floor position such that the child containment device is generally convertible between the play yard configuration, a bassinet configuration, and a sleeper configuration. In some example forms, the liner is substantially elastic and stretchable.

16 Claims, 10 Drawing Sheets

(56) References Cited

U.S. PATENT DOCUMENTS

| | | | | |
|---|---|---|---|---|
| 1,881,579 | A | 10/1932 | Hoch et al. | |
| 1,897,258 | A | 2/1933 | Jenne | |
| 2,287,907 | A | 6/1942 | Schettler, Jr. | |
| 2,423,402 | A | 7/1947 | Olsen | |
| 2,553,579 | A | 5/1951 | Harris | |
| 2,590,315 | A | 3/1952 | Hawley, Jr. | |
| 2,659,903 | A | 11/1953 | Hagelfeldt | |
| 2,784,420 | A | 3/1957 | Moltane | |
| 2,790,978 | A | 5/1957 | Tigrett | |
| 2,873,458 | A | 2/1959 | Adamson | |
| 2,948,287 | A | 8/1960 | Rupert | |
| 3,004,793 | A | 10/1961 | Loomis | |
| 3,092,847 | A | 6/1963 | De Puy | |
| 3,127,620 | A | 4/1964 | Peterson | |
| 3,146,736 | A | 9/1964 | Hetrick | |
| 3,162,460 | A | 12/1964 | Davidson | |
| 3,162,865 | A | 12/1964 | Tigrett | |
| 3,223,098 | A | 12/1965 | Dole, Jr. | |
| 3,273,862 | A | 9/1966 | Miller | |
| 3,309,719 | A | 3/1967 | Bader et al. | |
| 3,311,934 | A * | 4/1967 | Goldberg | A47D 13/02 5/102 |
| 3,658,025 | A | 4/1972 | Hood et al. | |
| 3,763,507 | A | 10/1973 | Propst | |
| 3,780,387 | A | 12/1973 | Propst | |
| 3,789,439 | A * | 2/1974 | Berg | A47D 9/005 5/93.2 |
| 3,848,277 | A | 11/1974 | Reguitti | |
| 3,874,005 | A | 4/1975 | Badon | |
| 3,875,623 | A | 4/1975 | Johnston | |
| 3,921,233 | A | 11/1975 | Mann | |
| 3,924,280 | A | 12/1975 | Vaiano | |
| 4,018,260 | A | 4/1977 | Baslow | |
| 4,105,244 | A | 8/1978 | Colby | |
| D300,787 | S | 4/1989 | Carter | |
| 4,823,415 | A | 4/1989 | Lampard | |
| 4,848,843 | A | 7/1989 | Gibbs | |
| 5,473,785 | A | 12/1995 | Lager et al. | |
| 5,613,543 | A | 3/1997 | Walton | |
| D398,161 | S | 9/1998 | Rosenbaum | |
| 5,802,634 | A | 9/1998 | Onishi et al. | |
| 5,819,340 | A | 10/1998 | Kelly | |
| 5,911,478 | A | 6/1999 | Goodman | |
| 5,957,436 | A | 9/1999 | Ristau | |
| 5,992,348 | A | 11/1999 | Harding | |
| 6,004,182 | A | 12/1999 | Pasin | |
| 6,076,448 | A | 6/2000 | Rexroad | |
| 6,098,217 | A | 8/2000 | Hammil | |
| 6,148,456 | A | 11/2000 | Tharalson et al. | |
| 6,158,067 | A | 12/2000 | Cheng | |
| 6,202,228 | B1 | 3/2001 | Cox | |
| 6,293,624 | B1 | 9/2001 | Gaylord et al. | |
| 6,301,731 | B1 | 10/2001 | Jakubowski et al. | |
| 6,339,855 | B1 | 1/2002 | Socha et al. | |
| 6,370,714 | B1 | 4/2002 | Elzenbeck | |
| 6,402,116 | B1 | 6/2002 | Northup | |
| 6,434,768 | B2 | 8/2002 | Brown et al. | |
| 6,438,772 | B1 | 8/2002 | Brown et al. | |
| 6,470,516 | B2 | 10/2002 | Lopez, Jr. | |
| 6,510,570 | B2 | 1/2003 | Hartenstine et al. | |
| 6,511,562 | B1 | 1/2003 | Coffield | |
| 6,560,795 | B2 | 5/2003 | Hsia | |
| 6,560,827 | B1 | 5/2003 | Gross | |
| 6,574,812 | B2 | 6/2003 | Jakubowski et al. | |
| 6,578,211 | B2 | 6/2003 | Tharalson et al. | |
| 6,585,323 | B2 | 7/2003 | Gaylord et al. | |
| 6,623,079 | B2 | 9/2003 | Gregory | |
| 6,704,949 | B2 | 3/2004 | Waldman et al. | |
| 6,779,849 | B1 | 8/2004 | Harper et al. | |
| 6,901,613 | B1 | 6/2005 | Hsia | |
| 6,934,981 | B2 | 8/2005 | Waldman et al. | |
| 6,954,949 | B1 | 10/2005 | Chen | |
| 7,013,505 | B2 | 3/2006 | Martin | |
| 7,017,203 | B2 | 3/2006 | Chen | |
| RE39,136 | E | 6/2006 | Tharalson et al. | |
| 7,063,096 | B2 | 6/2006 | Stoeckler | |
| D572,961 | S | 7/2008 | Costa | |
| 7,401,366 | B1 | 7/2008 | Costa | |
| 7,404,219 | B2 | 7/2008 | Berkey | |
| 7,415,739 | B2 | 8/2008 | Tharalson et al. | |
| 7,568,242 | B2 | 8/2009 | Troutman | |
| D605,870 | S | 12/2009 | Bergkvist et al. | |
| 7,739,759 | B2 | 6/2010 | Mendes et al. | |
| 7,752,693 | B2 | 7/2010 | Espenshade | |
| 7,818,832 | B2 | 10/2010 | Hartenstine et al. | |
| 7,882,579 | B2 | 2/2011 | Jackson et al. | |
| 8,112,835 | B2 | 2/2012 | Eirich et al. | |
| 8,141,186 | B2 | 3/2012 | Burns et al. | |
| 8,201,291 | B2 | 6/2012 | Burns et al. | |
| D678,693 | S | 3/2013 | Bergkvist et al. | |
| 8,429,771 | B2 | 4/2013 | Long | |
| 8,484,774 | B2 | 7/2013 | Cohen et al. | |
| 8,484,776 | B1 | 7/2013 | Su | |
| 8,528,130 | B2 | 9/2013 | Bu et al. | |
| 8,555,434 | B2 | 10/2013 | Chapman et al. | |
| 8,566,988 | B2 | 10/2013 | Son et al. | |
| D699,063 | S | 2/2014 | Stitchick et al. | |
| 8,640,278 | B2 | 2/2014 | You et al. | |
| 8,656,530 | B2 | 2/2014 | You et al. | |
| 8,677,526 | B2 | 3/2014 | Li | |
| 8,745,780 | B2 | 6/2014 | Su | |
| 8,756,728 | B2 | 6/2014 | Bergkvist | |
| 8,955,174 | B1 | 2/2015 | Lawlor et al. | |
| 9,021,629 | B2 | 5/2015 | Cheng | |
| 9,113,723 | B2 | 8/2015 | Greger et al. | |
| 9,149,128 | B2 | 10/2015 | Rampton et al. | |
| 9,198,524 | B2 | 12/2015 | Horst et al. | |
| 9,332,860 | B2 | 5/2016 | Rong et al. | |
| 2006/0000019 | A1 | 1/2006 | Martin | |
| 2007/0271697 | A1 | 11/2007 | Martin | |
| 2008/0022457 | A1 | 1/2008 | Wu | |
| 2009/0077742 | A1 | 3/2009 | Burns et al. | |
| 2010/0263121 | A1 | 10/2010 | Arnold, IV et al. | |
| 2011/0308011 | A1 | 12/2011 | Cheng et al. | |
| 2012/0012801 | A1 | 1/2012 | Burns et al. | |
| 2014/0068857 | A1 | 3/2014 | Jackson et al. | |
| 2016/0000232 | A1 | 1/2016 | Horst et al. | |

OTHER PUBLICATIONS

European Search Report for EP App. No. 16166936; 6 pgs; Jun. 8, 2016.

* cited by examiner

DEPTH-ADJUSTABLE FABRIC ENCLOSURE

CROSS-REFERENCE TO RELATED APPLICATIONS

This application claims the benefit of U.S. Provisional Patent Application Ser. No. 62/152,845 filed Apr. 25, 2015 and U.S. Provisional Patent Application Ser. No. 62/215,943 filed Sep. 9, 2015, the entireties of which are hereby incorporated herein by reference for all purposes.

TECHNICAL FIELD

The present invention relates generally to the field of infants' and children's accessories, and more particularly to fabric enclosures or liners for use with a support frame of a play yard.

BACKGROUND

Play yards are often used by parents and caregivers to provide a partially contained space for an infant or child to rest and play. Typically, a play yard includes a structural frame supporting a floor panel and sidewalls surrounding the contained space. Additional accessories such as a bassinet, changing table, and/or storage compartments can optionally be mounted to or supported by a play yard. Typically, play yards only function as a play yard, but can be configured with additional accessories, for example to provide a second floor panel or surface that is generally offset from the floor panel of the play yard, or can receive additional accessories that are generally coupled to the play yard.

Needs exist for continuing improvements in this field of endeavor. It is to the provision of a depth-adjustable fabric enclosure meeting these and other needs that the present invention is primarily directed.

SUMMARY

In example embodiments, the present invention provides a depth-adjustable fabric liner for coupling engagement with a structural support frame for use as a child containment device. In example forms, the depth-adjustable fabric liner provides for adjustability of the depth of the floor or bottom of the liner such that the bottom or floor portion of the liner is adjustable between at least two different heights. In example forms, the depth-adjustable fabric liner is adjustable relative to the structural support frame between a first floor position, a second floor position, and a third floor position such that the child containment device is generally convertible between a play yard configuration, a bassinet configuration, and a sleeper configuration.

In one aspect, the present invention relates to a depth-adjustable fabric enclosure for use with a structural support frame, the depth adjustable fabric enclosure including a sidewall enclosure and a floor panel. In one example form, the sidewall enclosure and the floor panel are coupled together to form a liner defining an internal containment volume therein, and the liner can be coupled to the structural support frame such that the liner can be positionable between two or more configurations.

In example forms, the two or more configurations can be in the form of a play yard configuration, a bassinet configuration, and/or a sleeper configuration. In example forms, at least one of the sidewall enclosure and the floor panel are generally formed from a substantially elastic and stretchable fabric. In example forms, in the play yard configuration, the floor panel of the liner is positioned at a first floor position. In the bassinet configuration, the floor panel of the liner is positioned at a second floor position. In the sleeper configuration, the floor panel of the liner is positioned at a third floor position.

In example forms, the sidewall enclosure includes a pair of connected side and end panels. Optionally, the upper portions of the side and end panels of the liner can define one or more flap portions for extending over cross-members of the structural support frame to support the liner. In some example forms, a separate sleeve is provided for permanent or removable engagement with the cross-members of the structural support frame, and wherein the liner can be permanently or removably connected to the sleeve. Optionally, one or more fastening members are coupled to the side and end panels or the floor panel for removable coupling engagement with the structural support frame. Optionally, a mattress is provided for insertion within the liner in to contact with at least a portion of the floor panel. In some example forms, the mattress is segmented and foldable, and one or more segments of the mattress can be folded or unfolded to decrease or increase a surface area thereof to accommodate placement within the liner in the two or more configurations.

In another aspect, the invention relates to a child containment device including a structural support frame and a liner. The structural support frame includes a plurality of corner posts and a plurality of cross-members extending between the corner posts. The liner is removably attached to the structural support frame, and the liner includes a sidewall enclosure extending between the corner posts of the frame and a floor panel engaged with the side and end wall panels. The sidewall enclosure and the floor panel generally define an internal containment volume.

In example forms, the child containment device is convertible between a play yard configuration, a bassinet configuration, and/or a sleeper configuration. In the play yard configuration, the floor panel of the liner is positioned at a first floor position. In the bassinet configuration, the floor panel of the liner is positioned at a second floor position. In the sleeper configuration, the floor panel of the liner is positioned at a third floor position. In one example form, the liner is formed from a single piece of fabric. In another example form, the liner is formed from two or more pieces of fabric. In one example form, the liner is substantially stretchable and resilient. In another example form, the liner is inelastic and non-stretchable.

Optionally, the liner can be formed from a combination of substantially stretchable and elastic fabrics and semi-stretchable fabrics. Optionally, the liner can be formed from a combination of stretchable, elastic fabrics and inelastic, non-stretchable fabrics. According to some example forms, the stretchable and elastic fabric is substantially resilient.

Optionally, an upper portion of the liner includes a flap portion integrally connected to and foldable relative to the liner for folding around at least a portion of the structural support frame. In example forms, the flap portion is in the form of one or more extensions of the sidewall enclosure. In example forms, convertibility between the two or more configurations is provided by one or more folds of the flap portion to reduce the allowable extension of the panels and thus raise the height of the floor panel height. Optionally, one or more fastening members are provided generally near the floor panel for removable attachment to portions of the corner posts, and convertibility between the two or more configurations is provided by moving the position of attachment of the fastening members with the corner posts.

Optionally, a mattress is provided for fitting engagement within the liner and in contact with the floor panel. In some forms, the mattress includes one or more foldable panels or segments. Preferably, the mattress can be folded and/or repositioned within the liner and positioned against the floor panel to accommodate fitting engagement with the liner in one or more of the configurations.

In yet another aspect, the invention relates to a child containment device including a structural frame and a depth-adjustable fabric enclosure connected to the structural frame. The structural frame includes a plurality of corner posts and a plurality of cross-members extending between the corner posts. The depth-adjustable fabric enclosure includes a sidewall enclosure and a floor panel. In example forms, the floor panel of the depth-adjustable fabric enclosure can at least be positioned between two or more heights to define two or more configurations of the child containment device These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the example embodiments are exemplary and explanatory of preferred embodiments of the invention, and are not restrictive of the invention, as claimed.

DETAILED DESCRIPTION OF EXAMPLE EMBODIMENTS

Figure 1:
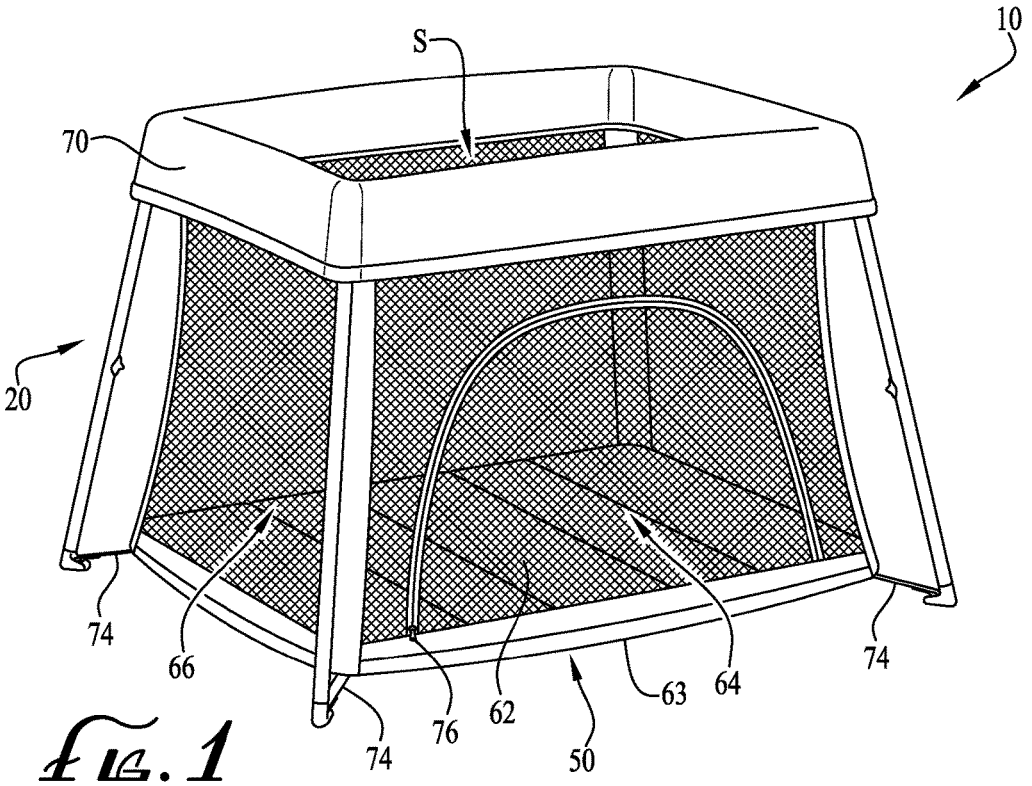
FIG. 1 is a perspective view of a play yard having a depth-adjustable fabric enclosure according to an example embodiment of the present invention, showing the play yard in an expanded use configuration and a floor portion of the depth-adjustable fabric is positioned at a first floor position.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-8 show a child containment device comprising a structural support frame 20 and a depth-adjustable fabric enclosure or liner 50 generally attached to the frame 20. In example embodiments, the depth-adjustable liner 50 is configured for ease of removal from the frame 20, for example to clean and replace the liner in ordinary usage of the child containment device. In alternative embodiments, the liner 50 can be configured for permanent attachment to the frame 20. Preferably, the depth-adjustable fabric liner 50 is configured to provide for adjustment to the depth of the floor or bottom of the liner (e.g., providing a plurality of different heights), for example, such that a bottom or floor portion of the liner 50 is adjustable between at least two different heights. As will be described below, the floor of the depth-adjustable fabric liner is preferably adjustable relative to the frame 20 between a first floor position, a second floor position, and a third floor position, for example, such that the child containment device is generally convertible between a play yard configuration 10 (see FIGS. 1 and 6), a bassinet configuration 10' (see FIG. 7), and a sleeper configuration 10" (see FIG. 8).

Figure 2:
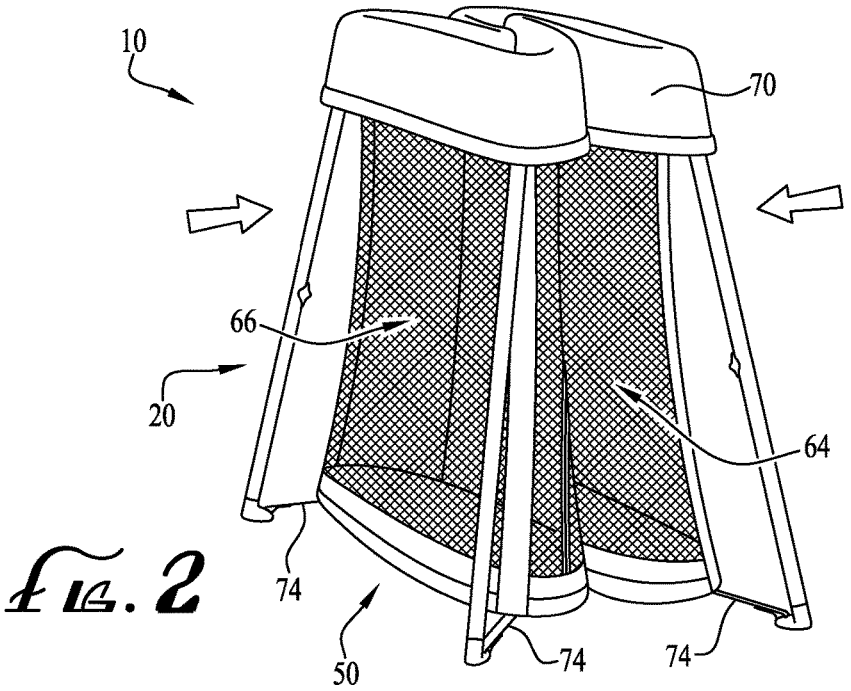
FIG. 2 is a perspective view of the play yard of FIG. 1, showing the play yard in a compact or folded configuration for storage and transport.

In example forms, with the liner 50 attached to the structural support frame 20, the play yard 10 can be configured in an expanded or unfolded configuration for use (see FIG. 1), or can be configured in a collapsed or folded configuration for storage or transport (see FIG. 2). In example embodiments, the frame 20 is constructed of substantially rigid tubing or bars formed of aluminum, steel, plastic or other structural material(s), and the liner 50 is constructed of polyester, cotton, or other natural or synthetic fabric or other flexible material(s). In example embodiments, as recited above, the liner 50 can preferably be either removably attached to the frame 20 or permanently attached thereto. For example, as will be described below, according to some example embodiments of the present invention, the liner 50 is flexible and substantially stretchable and elastic such that the liner 50 can generally be configured so that the height of the floor or bottom portion of the liner 50 is adjustable between at least two different heights. The tubing or bars of the frame optionally comprise a round, oval, square, rectangular or other cross-sectional shape(s), and the liner attachments are compatible with frame members of different configurations. The liner 50 optionally includes one or more panels of mesh or other materials providing visibility and breathability through the liner. According to some example forms, the mesh or visibility material can be formed from a substantially elastic material. Optionally, one or more panels of the liner 50 can comprise one or more couplings or engagement members or mechanisms (e.g., zippers, clasps, clips, etc.) such that at least a portion of the panel(s) can be uncoupled to provide an opening or access therethrough (as will be described below).

Figure 3:
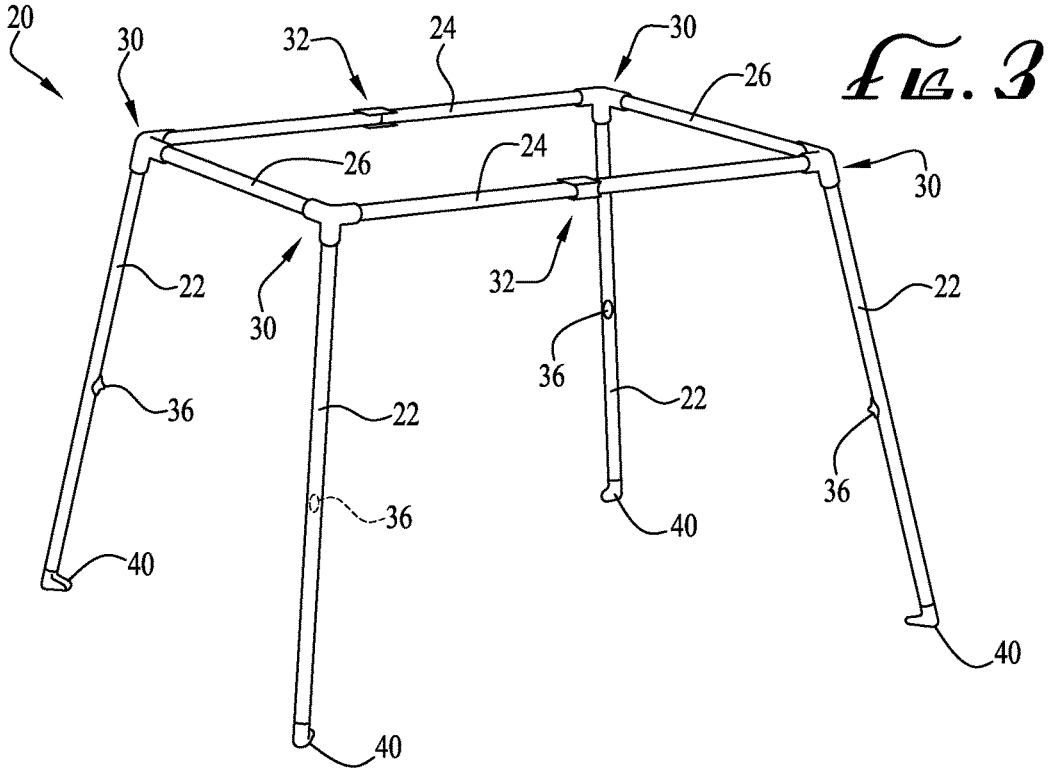
FIG. 3 is a perspective view of a support frame of the play yard of FIG. 1, wherein the support frame is in the expanded configuration.
Figure 4:
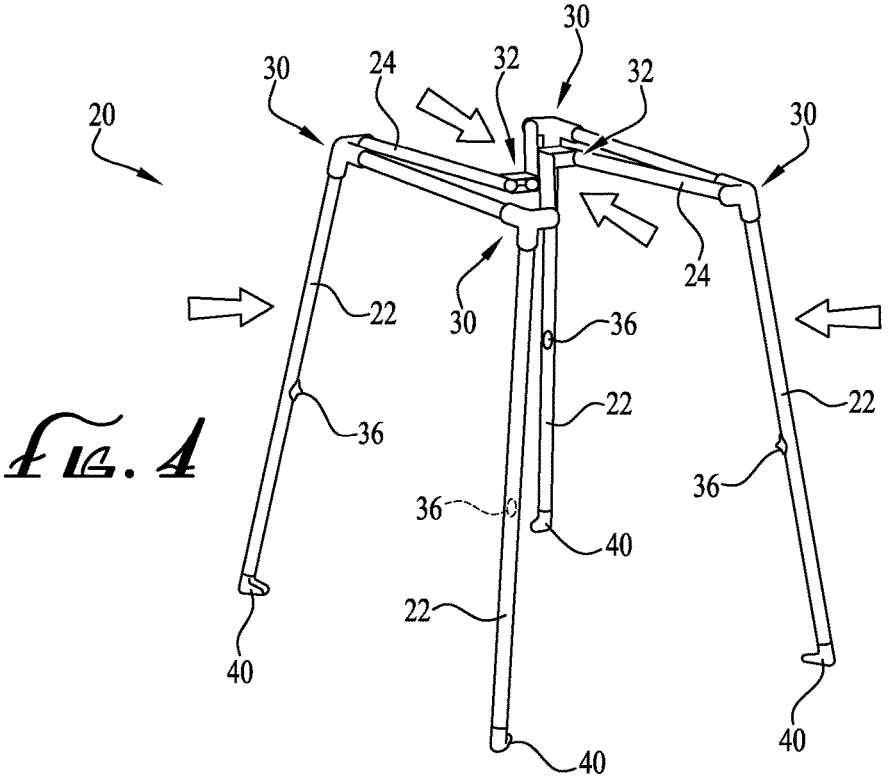
FIG. 4 is a perspective view of the support frame of FIG. 3, wherein the support frame is in the collapsed configuration.

As depicted in FIGS. 3-4, the frame 20 comprises four generally upright corner posts 22, first and second upper side cross-members 24, and first and second upper end cross-members 26, forming a generally rectangular three-dimensional housing bounding an internal contained volume or space S for structurally supporting the liner 50 to receive a child therein. In the depicted embodiment, the side cross-members 24 are longer than the end cross-members 26, defining a containment having a length greater than its width. In alternate embodiments, the length and width may be generally equal (e.g., forming a square or cubed three-dimensional housing), or the width can be greater than the length. In alternative embodiments, the three-dimensional housing can be shaped as desired, for example, wherein the three-dimensional housing cross-sectional shape (e.g., taken along a horizontal plane parallel with the support surface and generally coinciding with the cross-members 24, 26) can be generally oval, circular, triangular, or otherwise shaped as desired. Optionally, the assembly of the frame (e.g., corner posts 22, first and second upper side cross-members 24, and first and second upper end cross-members 26) an be shaped and connected as desired, for example, to form a desirable three-dimensional shape to provide for permanent or removable connection between the corner posts 22, the first and second upper side cross-members 24, and the first and second upper end cross-members 26. In some example forms, the corner posts 22 and/or the cross-members 24, 26 are at least partially curved or radiused, for example, to provide a desired three-dimensional housing.

In example embodiments, the frame 20 is collapsible or foldable for more efficient storage and transport when not expanded and set up for use. For example, in the depicted embodiments, first and second ends of the side cross-members 24 are pivotally connected by hinged or pivotal end coupling joints 30 to upper ends of the corner posts 22. The ends of the cross-members 26 are generally fixedly engaged with the coupling joints 30, for example, so that they do not pivot relative to the coupling joints 30. Thus, according to example forms, the end coupling joints 30 are configured such that the first and second ends of the side cross-members 24 are pivotally coupled to the end coupling joints 30 and the first and second ends of end cross-members 26 are fixedly engaged with the end coupling joints 30. However, according to other example forms, the ends of the end cross-members 26 can be pivotally connected to the end coupling joints 30. The side cross-members 24 optionally also include hinged or pivotal medial coupling joints 32 about midway along their lengths. One or more of the coupling joints 30, 32 are optionally lockable to releasably retain the frame in the expanded and/or folded configurations, for example latching or locking when opened into the expanded configuration (FIG. 3), and requiring manual actuation by an adult caregiver to release the frame for folding (FIG. 4) and prevent inadvertent folding by a child contained in the play yard 10. Thus, in example embodiments, the frame 20 is foldable between the expanded configuration (FIG. 3) and the collapsed configuration (FIG. 4) with the liner 50 installed or removed.

In the depicted embodiment, the corner posts 22 generally extend at least partially outwardly, for example, from the coupling joints 30 to the ground surface (e.g., supporting the frame 20) to define a generally trapezoidal/pyramid frame. Optionally, the corner posts 22 are generally configured to extend substantially vertical (e.g., up and down). In one example form, the frame 20 can be configured to define a 2-dimensional generally trapezoidal shape when viewed from the sides or ends, for example, wherein the corner posts 22 generally extend at least partially outwardly in two dimensions. Optionally, in other example forms, the frame 20 can be configured to define a 3-dimensional pyramid-like (e.g., pyramidal-frustum) shape, for example, where the corner posts 22 generally extend outwardly from the coupling joints in three dimensions.

One or more of the corner posts 22 optionally includes a liner attachment loop 36 for receiving a strap or other attachment portion of the liner 50, for example at or adjacent the upper or medial portion of the post. The corner posts optionally further comprise base supports or feet 40 at lower ends thereof, which can optionally include wheels or casters for rolling support and repositioning of the play yard. In some example forms, one or more of the feet 40 generally comprise a rubberized or other high friction engagement portion, for example, so that the feet 40 (and thus the corner posts 22 and frame 20 thereof) remain generally engaged and grounded with a support surface, for example, a floor or other surface that the frame 20 is resting on. According to some example forms, the feet 40 preferably additionally provide for attachment with at least a portion of the liner 50, for example, to provide for fitting engagement of the liner 50 with the frame 20 (as will be described below).

In alternate example embodiments, the frame 20 can comprise an accessory mount, for example at or adjacent an upper end of the corner posts, for supporting a sleeper, bassinet, changing table, container or other accessories. Furthermore, the frame 20 can optionally include one or more lower diagonal cross-members pivotally or hingedly connected at one end to the feet 40 or lower ends of the corner posts 22, and at the other end to a central base coupling hub, and wherein lateral side cross-members can optionally extend between adjacent lower diagonal cross-members, and may include support feet with pivotal or hinged couplings at or adjacent their midpoints, and pivotal and/or sliding couplings at ends thereof. U.S. patent application Ser. No. 15/047,912 is owned by the applicant, is incorporated herein by reference, and shows an example collapsible frame for a child containment device. Optionally, in alternate example embodiments, the frame can generally be a substantially rigid frame that is not foldable or collapsible.

According to some example forms, the frame 20 can optionally adjust up and down, for example, to increase or decrease the height of the upper side and end cross-members 24, 26. For example in some example forms, the corner posts 22 can be configured to provide for the adjustment in their length thereof, for example, by providing telescoping corner posts. In example forms, the telescoping corner posts can comprise one or more locking or adjustment members or clips such that an operator can easily adjust the length of the corner posts. Furthermore, according to some example forms, the upper side and end cross-members 24, 26 can be telescoping to provide adjustability to their respective lengths thereof.

Figure 5:
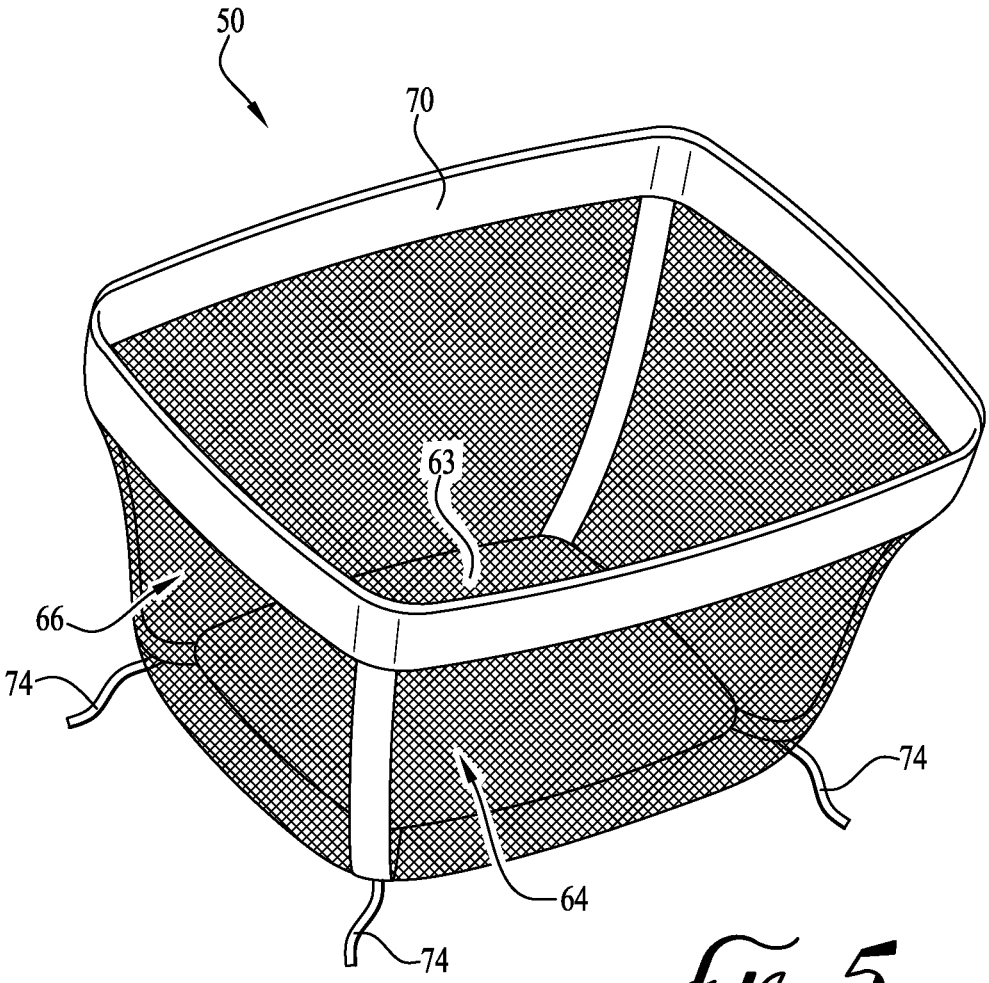
FIG. 5 is a perspective view of the depth-adjustable fabric enclosure of FIG. 1, wherein the depth-adjustable fabric enclosure is in a relaxed, natural, non-stretched state.

FIG. 5 shows the liner 50 in greater detail and removed from the frame 20. As depicted, the liner 50 is in a relaxed, unstretched state, and comprises a generally rectangular base or floor panel 63 and a sidewall enclosure. In example embodiments, the sidewall enclosure comprises first and second generally rectangular side wall panels 64, and first and second generally rectangular end wall panels 66. In example forms, an upper portion of the rectangular side wall panels 64 and the rectangular end wall panels 66 of the liner 50 can comprise a flap portion 70, which is positioned at the open end of the rectangular side wall panels 64 and the rectangular end wall panels 66, and which extends substantially around the entire upper periphery of the liner 50, for example, which can be folded outwardly around at least a portion of the side and end cross-members 24, 26 (and the end coupling joints 30 coupled therebetween). Thus, in example embodiments, the flap portion 70 is integral with the sidewall enclosure and is a portion of the side and end wall panels 64, 66. According to example embodiments, the flap portion 70 can be formed from a plurality of flap portions, for example, wherein each of the upper portions of the side and end wall panels 64, 66 comprise a flap portion, and wherein connection of the side and end wall panels 64, 66 (forming the sidewall enclosure) connects each of the flap portions together to define the flap portion 70. Optionally, a stiffening member or additional fabric portion can be provided with the flap portion 70, for example, to provide additional stiffness and rigidity of the flap portion 70. Optionally, the flap portion 70 (or multiple flap portions) can be removably mounted to an upper portion of the side and end wall panels 64, 66. In some example forms, one or more fasteners are provided for removable engagement of the flap portion 70 with one or more portions of the frame 20 and/or the liner 50. Optionally, the flap portion 70 comprises one or more inserts or coupling members or clips mounted thereto (or to a portion of the liner 50) for providing for coupling engagement with the frame 20 (or cross-members 24, 26).

In some example forms, one or more straps, loops, or other fastening members 74 extend from a portion of the liner 50, for example, generally at or near the base 63 (or side or end wall panels 64, 66) for coupling to the corner posts 22 of the frame 20, or for example, for coupling to the liner attachments (e.g., loops 36 and/or the feet 40) of the corner posts 22. In some example forms, the liner attachments can be provided by one or more clasps, clips or other connectors or couplings for connecting to and disconnecting from the fastening member 74 to provide for quick and secure coupling engagement with the frame 20 (or to one or more portions thereof) in the various configurations as described herein.

Figure 6:
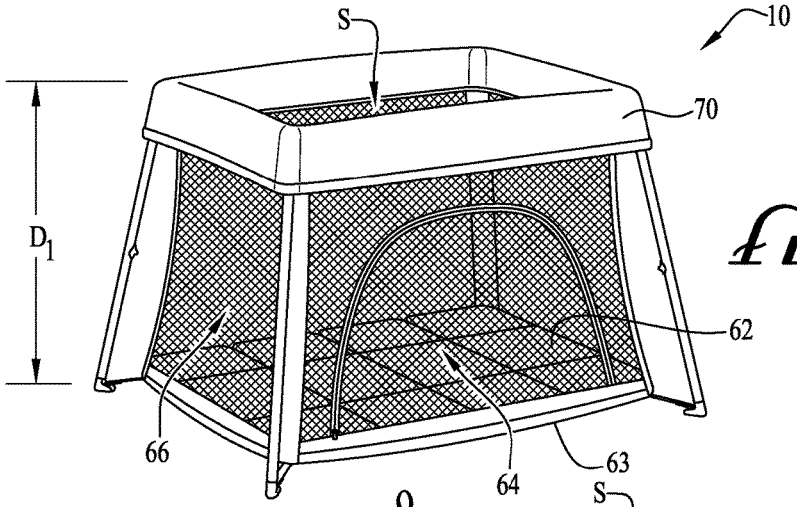
FIG. 6 is another perspective view of the play yard of FIG. 1.
Figure 7:
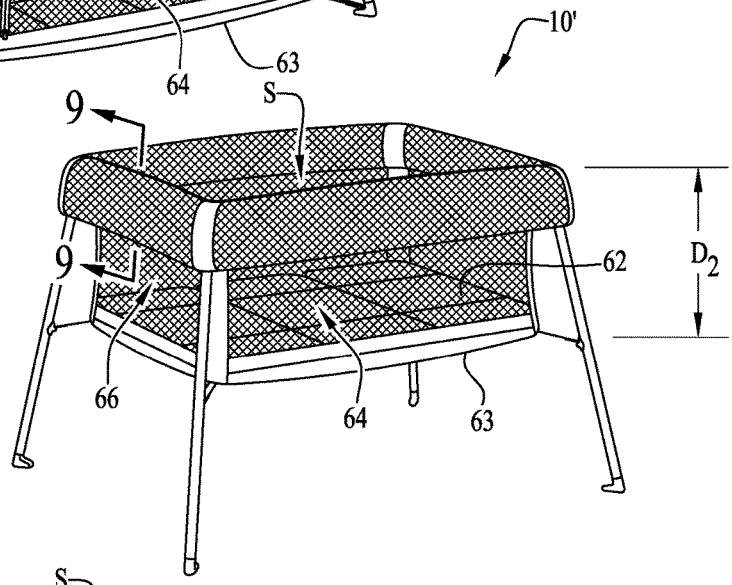
FIG. 7 is a perspective view of the play yard of FIG. 6, wherein the depth-adjustable fabric enclosure is configured as bassinet according to another example embodiment of the present invention, with the floor of the depth-adjustable fabric enclosure positioned at a second floor position.
Figure 8:
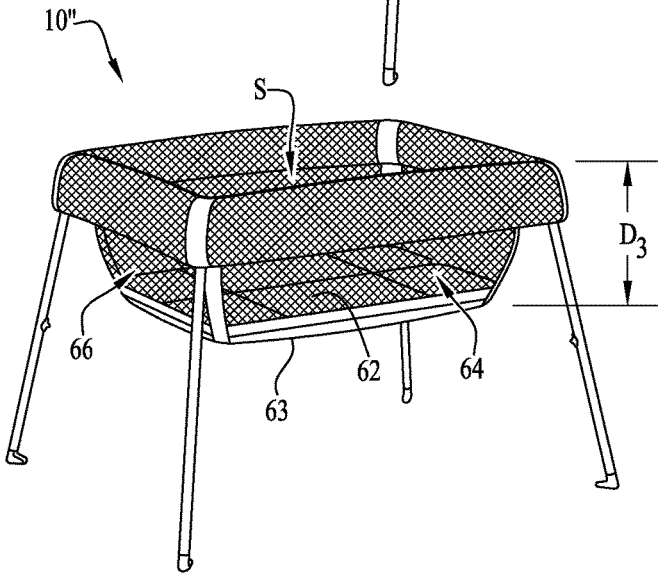
FIG. 8 is a perspective view of the play yard of FIG. 6, wherein the depth-adjustable fabric enclosure is configured as a sleeper, according to another example embodiment of the present invention, with the floor of the depth-adjustable fabric enclosure positioned at a third floor position.

In example embodiments, the liner 50 is stretchable and elastic to provide for the convertibility between the two or more configurations (e.g., the play yard configuration 10 of FIGS. 1 and 6, the bassinet configuration 10' of FIG. 7 and the sleeper configuration 10" of FIG. 8). According to some example forms, the liner 50 is formed from a single piece of fabric, which is substantially stretchable and elastic, for example to accommodate a substantially large change in its size or dimensions to provide for convertibility between the configurations. Optionally, two or more single pieces of fabric are assembled together to form the liner 50. In example embodiments, about two or more pieces of inelastic, non-stretchable fabrics can be used to form the liner. Optionally, one or more pieces of inelastic fabric can be combined with one or more pieces of elastic fabric, for example, such that the liner is formed from a combination of both inelastic (not stretchable) and elastic (stretchable) fabrics. Further optional, one or more pieces of inelastic fabric can be combined with one or more pieces of semi-elastic fabric, or for example, the liner can be formed with one or more desired fabrics or other generally flexible sheet materials, or other woven materials, and wherein the elasticity and elastic deformation (e.g., stretchability) of the material(s) can be chosen as desired. In example embodiments, one or more pieces of fabric can be generally sewn, heat bonded or welded, glued, or otherwise attached together as desired. As shown in FIG. 5, the liner 50 is in its natural, unstretched state, which is substantially smaller than the liner 50 when it is coupled to the frame 20 and configured as a play yard 10. According to one example form, the liner 50 comprises one or more stretch fabrics, which can preferably provide for a 2-way and/or 4-way stretch, for example, so that the liner 50 is capable of being converted between the configurations to provide adjustment to the depth/height of the floor 63. Optionally, in other example forms, the fabric of the liner 20 can preferably be formed from other stretchable or elastic materials, or can be formed from a combination of materials (both stretchable and elastic and/or generally semi-elastic).

In example embodiments, the fabric is substantially resilient such that the liner 50 does not remain stretched after normal use, but instead generally retains its elasticity, for example such that the dimensions of the liner 50 in its relaxed, unstretched state are between about 15% to about 65% percent smaller than the dimensions of the liner 50 in its expanded configuration with the base positioned at a first floor position (see FIGS. 1 and 6). According to some example forms, the dimensions of the liner 50 in its relaxed, unstretched state are between about 20%-45%, more preferably about 35%, smaller than the dimensions of the liner 50 in its expanded configuration with the base 63 positioned at a first floor position (e.g., generally the maximum expansion of the liner 50). Thus, according to example forms of the present invention, the liner 50 in its relaxed, unstretched state can be stretched (generally outwardly and by and outward, external force) such that the dimensions of the liner in the expanded configuration are generally between about 15%-65% larger than the dimensions of the liner 50 in the relaxed, unstretched state as depicted in FIG. 5. Preferably, the liner 50 comprises a sufficient amount of elasticity such that the liner 50 can be stretched and adjustable relative to the frame 20, for example, which can generally be trapezoidal or pyramid-shaped. Optionally, in other example embodiments of the present invention, the liner 50 can be preferably shaped as desired, for example, generally comprising a circular, oval, elliptical or other cross-sectional shape, for example, and wherein the floor panel is generally shaped to match the cross-sectional shape. Optionally, a generally single side panel extends around the entire periphery and is generally coupled to the floor panel 63. Preferably, the floor panel 63 can be shaped as desired. In alternate example embodiments, the liner 50 can be configured to expand/retract similar to an accordion, for example, wherein a plurality of resilient folds facilitate in the expansion/retraction of the liner between the configurations.

FIGS. 6-8 show the child containment device in the play yard 10 configuration (see FIGS. 1 and 6), the bassinet 10' configuration (see FIG. 7), and the sleeper 10" configuration (see FIG. 8). In example embodiments, the child containment device (e.g., the structural support frame 20 and the liner 50) is convertible between the play yard 10, the bassinet 10', and the sleeper 10" configurations, for example, wherein the liner 50 is substantially stretchable and elastic (e.g., tensionable) such that when the liner 50 is coupled to the frame 20, the floor panel 63 of the liner 50 (or mattress portion 62 therein) can be positioned between a first floor position (play yard 10), a second floor position (bassinet 10'), and a third floor position (sleeper 10"). For example, as shown in FIG. 6, in the play yard configuration 10, a depth $D_1$ is defined between the upper perimeter of the child containment device (or flap 70) and the floor panel 63 (or mattress portion 62 therein), for example, which is generally between about 20-35 inches, more preferably between about 21-30 inches, for example between about 21-26 inches according to one example embodiment. According to example forms, when the child containment device is in the play yard configuration 10 with the liner 50 positioned in the first floor position, the base 63 of the liner 50 is generally in contact with the support surface or ground surface that is supporting the support frame 20. Optionally, according to other example embodiments, the frame 20 can comprise lower supports (see FIG. 20) on which the base 63 of the liner 50 can rest (e.g., causing the base 63 to become offset from the ground surface), or the liner 50 can generally be suspended and offset from the ground surface, for example, as shown in FIGS. 7 and 8.

As shown in FIG. 7, in the bassinet configuration 10', a depth $D_2$ is defined between the upper perimeter of the child containment device and the floor panel 63 (or mattress portion 62 therein), for example, which is generally between about 6-16 inches, more preferably between about 7-14 inches, for example between about 7.5-12 inches according to one example embodiment. As shown in FIG. 8, in the sleeper configuration 10", a depth $D_3$ is defined between the upper perimeter of the child containment device and the floor panel 63 (or mattress portion 62 therein), for example, which is generally between about 6-16 inches, more preferably between about 7-14 inches, for example between about 7.5-12 inches according to one example embodiment. Thus, in some example embodiments, the depth $D_3$ can be substantially similar to the depth $D_2$. Alternatively, the depth $D_3$ can be chosen as desired, for example, which can be generally less than the depth $D_2$. According to example embodiments, the internal containment volumes S of the play yard 10, bassinet 10', and sleeper 10" are generally different, for example, wherein the internal containment volume S of the play yard 10 is larger than the internal containment volumes S of the bassinet 10' and sleeper 10", wherein the internal containment volume S of the bassinet 10' is smaller than the internal containment volume S of the play yard 10 but generally larger than the internal containment volume S of the sleeper 10", and wherein the internal containment volume of the sleeper 10" is generally smaller than the internal containment volumes S of the play yard 10 and the bassinet 10'. Reference herein to the internal containment volume S is understood to mean the containment volume defined by the liner 50 in the respective configurations.

Figure 9:
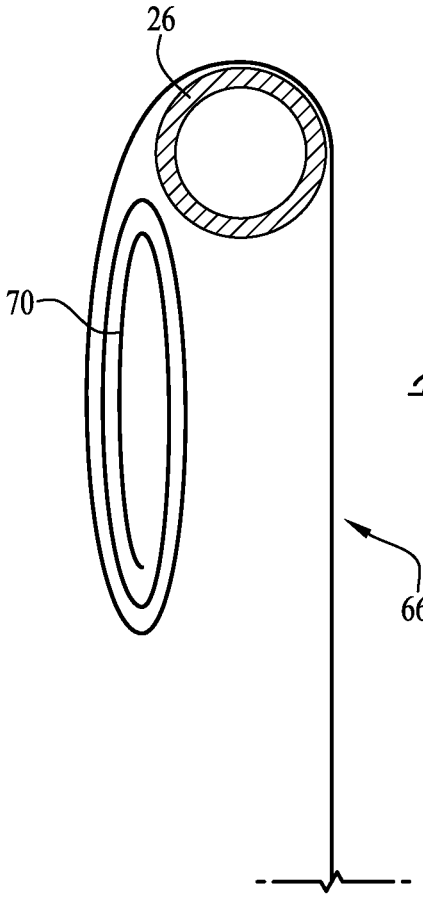
FIG. 9 shows a cross-sectional view of an upper portion of the depth-adjustable fabric enclosure folded and engaged with the support frame of FIG. 7 taken along line 9-9

As depicted in FIGS. 6-8, to convert the child containment device from the play yard configuration 10 to one of the bassinet or sleeper configurations 10', 10", the upper flap portion 70 is folded or rolled towards the panels 64, 66 such that at least a portion of the panels 64, 66 is generally folded and rolled up with the upper flap portion 70, and thus causing the floor panel 63 to generally raise from the ground surface to either of the second or third floor positions. For example, as depicted in FIGS. 7-8, at least a portion of the panels 64, 66 is generally rolled or folded with the upper flap portion 70 to cause adjustment to the height of the floor panel 63 (also see FIG. 9). According to some example forms, one or more fasteners can be provided for removably coupling the upper flap portion 70 to the frame 20 (or to a portion of the liner 50), or for example, for securing the rolled flap (e.g., comprising at least a portion of the panels rolled therewith) to the frame 20 or to a portion of the liner 50).

According to preferred example forms, the elasticity of the liner 50 additionally causes retraction of the liner 50, and thus a reduction to the internal containment volume S thereof, for example, which preferably assists in adjustment in the height of the floor panel 63. Optionally, in other example embodiments, the upper flap portion 70 remains generally folded at least partially around the upper side and end cross-members 24, 26, and the elasticity of the liner 50 generally solely causes adjustment to the internal containment volume S and the height of the floor panel 63 relative to the ground surface. As shown, in some example forms, one or more fastening members 74 can be provided with the liner 50 for quick and secure coupling engagement and disengagement with the liner attachments of the frame 20 (or to one or more portions thereof), for example, to generally position the floor panel 63 at a desirable height.

Figure 10:
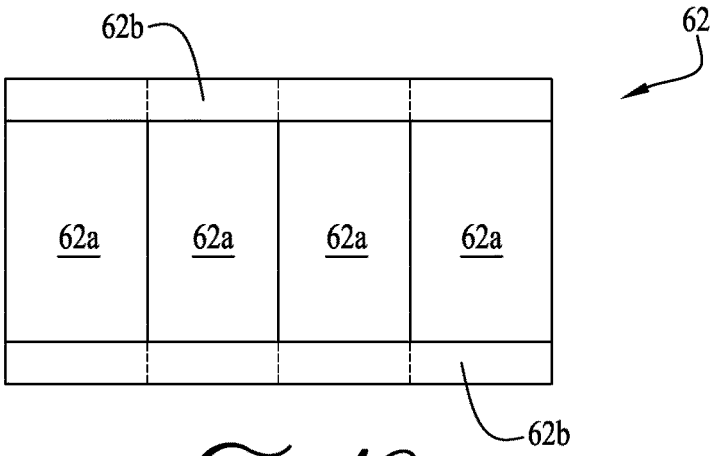
FIG. 10 is a top plan view of a mattress for use with the depth-adjustable fabric enclosure of FIG. 1 according to an example embodiment of the present invention.

In example forms as described above, a floor platform or mattress 62 is optionally provided for placement on the floor panel 63 of the liner 50 within the contained space S bounded by the side walls 64 and end walls 66. In example forms, the mattress 62 generally comprises a plurality of foldable segments having internal cushioning and support, which preferably is generally foldable to accommodate convertibility between the configurations (e.g., play yard, bassinet and sleeper) and to facilitate storage or travel. For example, according to some example forms of the invention and as described above, at least some of the dimensions of the liner 50 are generally reduced or enlarged between configurations. As depicted in FIG. 10, the mattress panel 62 generally comprises a plurality of foldable panels or segments, for example, generally central rectangular segments 62*a*, and side rectangular segments 62*b*. In example forms, the segments 62*a*, 62*b* are generally configured to fold relative to each other, for example, to increase or reduce the surface area thereof such that the mattress 62 can be adapted to the size of the floor panel 63 based on the configuration of the child containment device. In example forms, the entire available surface area (e.g., no segments folded) of the mattress 62 is used in the play yard configuration 10. In the bassinet configuration 10', the side rectangular segments 62*b* are generally folded to lie underneath the central rectangular segments 62*a*, for example, as the dimensions of the base 63 of the liner 50 are generally at least partially smaller or reduced such that at least some of the surface area of the mattress 62 is generally removed.

Figure 11:
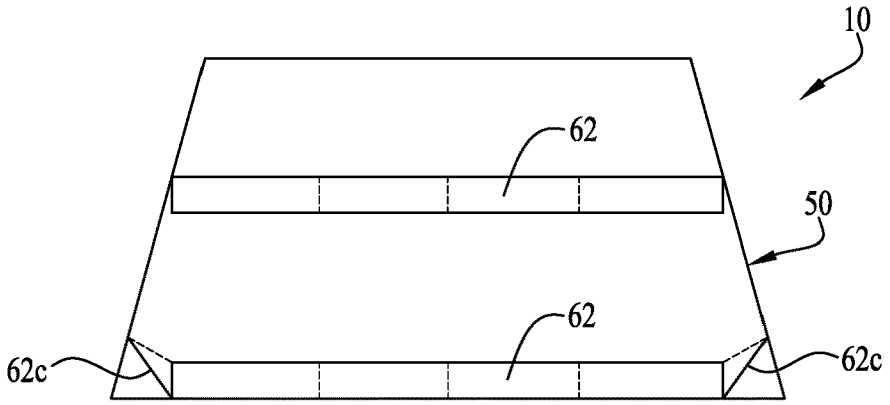
FIG. 11 is a side plan view of the depth-adjustable fabric enclosure and the mattress of FIG. 1, showing the movement and positioning of the mattress between the first and the second floor positions.

As depicted in FIG. 11, one or more gussets, wedges or flaps 62*c* can be incorporated with the liner 50, for example, to generally extend from one or more of the panels' 64, 66 edges of the liner 50 to the mattress 62 (or edges thereof). In some example forms, the flaps 62*c* can comprise internal cushioning and support as similarly described with respect to the mattress 62. In some example forms, the flaps 62*c* generally extend from the one or more panels of the liner 50 such that they generally engage or contact a bottom outer edge of the mattress 62. Optionally, the flaps can extend from the panels of the liner 50 such that they generally engage a top corner portion of the mattress 62, or for example, generally extending at least partially on a top surface of the mattress 62 (see dashed lines). Optionally, the flaps 62*c* can be configured as desired, for example, for connection with the mattress 62, or for engagement with the mattress 62 such that a generally smooth transition is provided therebetween.

In some example forms, the flaps 62*c* can be removable from the liner 50, or for example, the flaps 62*c* can be formed from different lengths, for example, such that a first flap comprising a first dimension is generally removably engaged with the liner 50 in the play yard configuration 10, but wherein a second flap comprising at least partially smaller dimension would be removably engaged with the liner 50 in the bassinet configuration 10'. Optionally, a third flap (comprising a generally smaller dimension than the second flap) could be provided for removable engagement with the liner 50 in the sleeper configuration 10". In other example embodiments, a flap 62*c* is generally provided for the bassinet and sleeper configurations 10', 10", but typically flaps are not needed for the play yard configuration 10, for example, wherein the dimensions of the mattress 62 are generally configured for engagement with the floor panel 63 and the bottom of the panels 64, 44 of the liner 50 near the floor surface 63. Thus, when the liner 50 is in a substantially stretched and expanded configuration (see FIG. 1), the mattress 62 is generally provided with a snug fit atop the floor 63 and the bottom portions of the panels 64, 66. However, according to other example embodiments of the present invention, for example as depicted in FIG. 11, the liner 50 comprises one or more flaps 62*c* for abutment or engagement, or for example, generally in close proximity to the outer edges of the mattress 62 or a corner portion or top surface of the mattress 62. Thus, in some example forms, as depicted in FIG. 11, with the flap 62*c* removably engaged with the liner 50 (e.g., an internal surface of the liner bounding the internal containment volume S) at least one dimension of the mattress 62 remains the same between the play yard and bassinet configurations 10, 10'.

Figure 12:
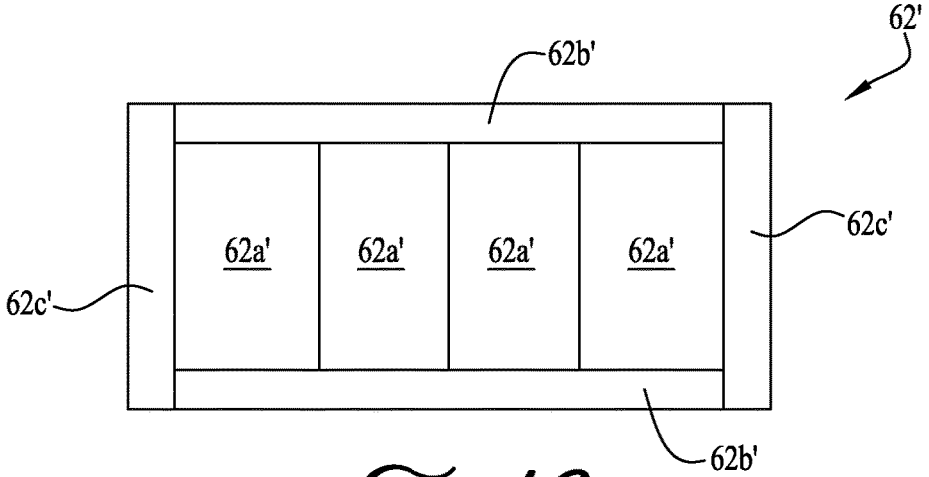
FIG. 12 shows a top plan view of a mattress for use with the depth-adjustable fabric enclosure of FIG. 1 according to another example embodiment of the present invention.

In alternate example embodiments, as depicted in FIG. 12, a mattress 62' comprises a plurality of foldable panels or segments, for example, generally central rectangular segments 62*a*', side rectangular segments 62*b*' and end rectangular segments 62*c*'. In example forms, the segments 62*a*', 62*b*', and 62*c*' are generally configured to fold relative to each other, for example, to increase or reduce the surface area thereof such that the mattress 62' can be adapted to the size of the floor panel 63 based on the configuration of the child containment device (e.g., play yard, bassinet or sleeper). According to some example forms, one or more mattress panels are generally folded relative to each other such that the surface area of the mattress 62 is generally reduced, for example to engage the floor panel 63 in the bassinet configuration 10' or the sleeper configuration 10". In some example forms, the mattress 62 can generally be rotated 90 degrees before installation within the liner 50 and in contact with the floor surface 63, for example, for reconfiguring the mattress 62 from being used in the play yard configuration 10 (maximum surface area) to a configuration (e.g., bassinet or sleeper) where the floor surface 63 is generally not expanded or stretched as much, for example, which reduces the dimensions thereof. In some example forms, the mattress can be configured, for example, as described in U.S. patent application Ser. No. 14/021,934, which is owned by the applicant and shows a plurality of different mattress configurations, the entirety of which is incorporated herein by reference.

According to some example forms, some of the mattress panels (or at least portions of the panels) can be formed from a resiliently flexible material, or a combination of resilient and flexible materials, for example, such that a portion thereof can be substantially folded relative to another portion of the same panel. For example, as depicted in FIG. 12, the side and end rectangular segments 62*b*', 62*c*' can be configured to substantially fold, for example, when it is desirable to fold one or more of the segments 62*a*' relative to each other, or for example, by folding the side rectangular segments 62*b*' relative to the central rectangular segments 62*a*' (see dash lines indicating where the segments 62*b*', 62*c*' can be folded as desired. Optionally, a hinge or other pivotal member or coupling can be provided for allowing pivoting or folding of a portion of a segments relative to another, for example, which is generally how the segments 62*a*', 62*b*' and 62*c*' are generally foldably coupled together.

Figure 13:
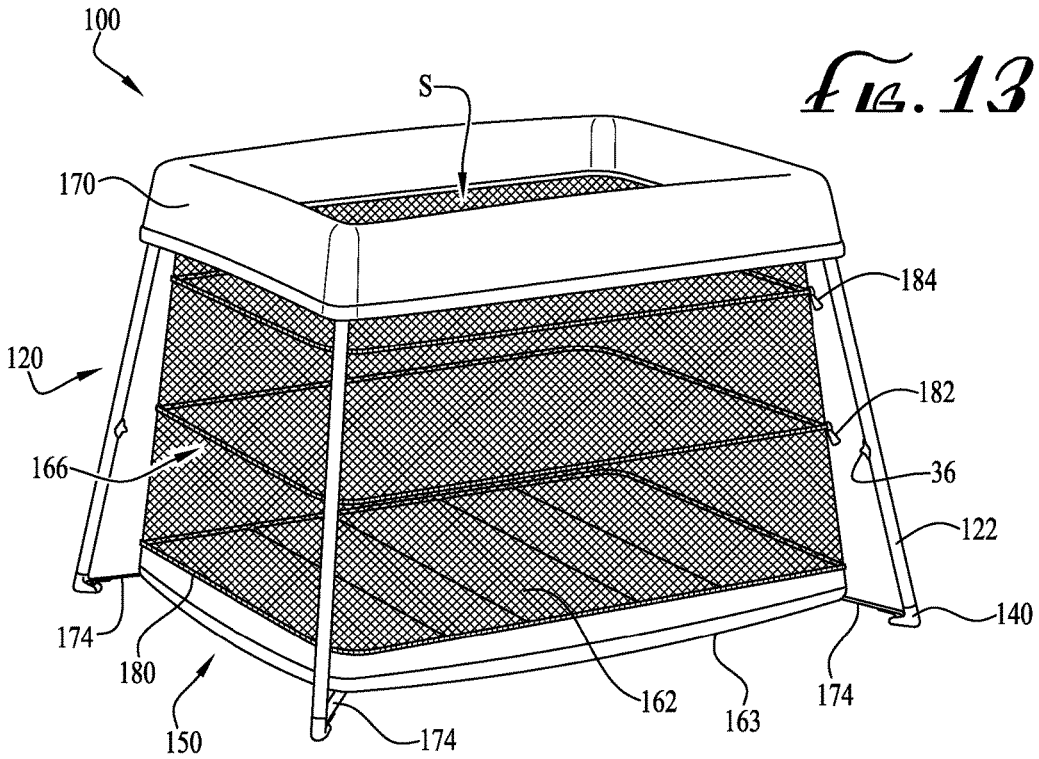
FIG. 13 is a perspective view of a play yard having a depth-adjustable fabric enclosure according to another example embodiment of the present invention, wherein a floor portion of the depth-adjustable fabric is positioned at a first floor position.
Figure 14:
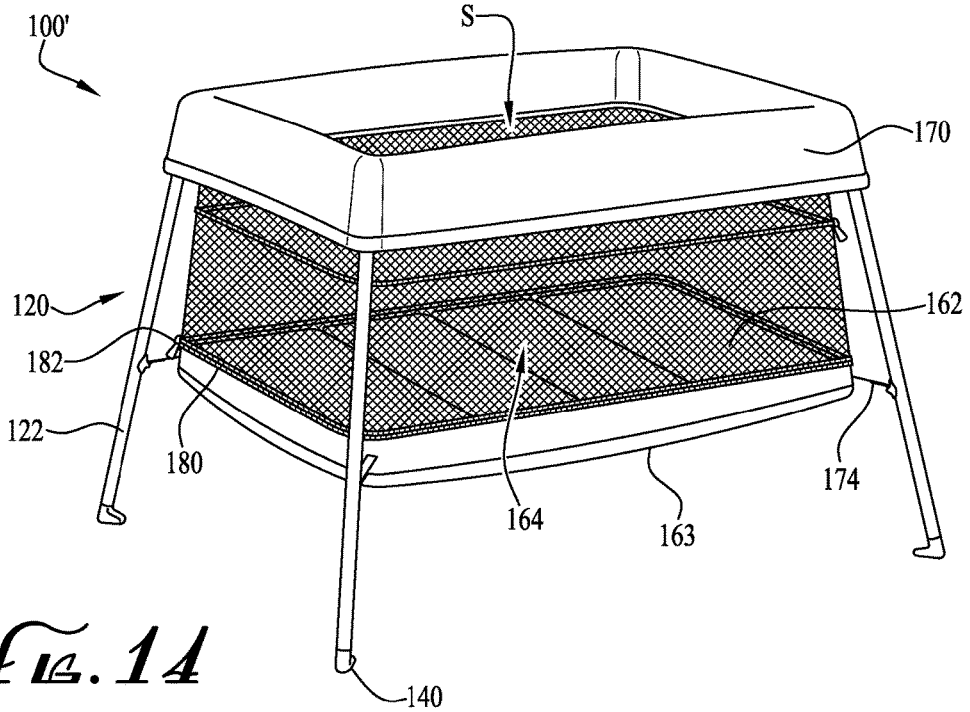
FIG. 14 is a perspective view of the play yard of FIG. 13, showing the depth-adjustable fabric enclosure configured as a bassinet, according to another example embodiment of the present invention, with the floor of the depth-adjustable fabric enclosure is positioned at a second floor position.

FIGS. 13-14 show a child containment device according to another example embodiment of the present invention. As depicted, the child containment device comprises a structural support frame 120 and an enclosure or liner 150. As similarly described above, the liner 150 is removably mounted to the structural support frame 20 and convertible between two or more floor positions, for example, such that the child containment device is convertible between a play yard configuration 100, a bassinet configuration 100', and a sleeper configuration (not shown).

As similarly described above, the liner 150 generally includes side panels 164, end panels 166, and a floor panel 163. In example forms, an upper portion of the side and end panels 164, 166 of the liner 150 can comprise a flap portion 170, which is positioned at the open end of the rectangular side wall panels 164 and the rectangular end wall panels 166. In example embodiments, the flap portion 170 is at least partially folded around a portion of the support frame 120. In example forms, instead of generally folding the flap portion 170 on itself as described above, a pair of zippered teeth 180, 182 and 184 are provided and generally extend horizontally around the periphery of the liner 50 (e.g., generally extending along each panel 164, 166 at the same height), to provide for interengagement therebetween, for example, to adjust the height of the mattress 162 (or the floor panel 163) relative to the support or ground surface. Preferably, the floor panel 163 is generally contacting or engaging the ground surface when the child containment device is in the play yard configuration 100.

As shown in FIG. 14, the child containment device is in the bassinet configuration 100' and the horizontal extension of zippered teeth 180 are generally interengaged with the zippered teeth 182, for example, which are generally positioned at a height that is greater than the bottom of the panels 164, 166, but is generally shorter than a top portion of the panels 164, 166. In example forms, the zippered teeth 184 are similarly interengageable with the zippered teeth 180, for example to convert the child containment device to a sleeper configuration. Optionally, one or more fastening members 174 and be provided for securing at least portions of the liner 150 to the support frame 120. In some example forms, the liner 150 is formed from a substantially stretchable and resilient fabric as described above. In alternate embodiments, the liner 150 is formed from a plurality of substantially inelastic, non-stretchable fabrics. Optionally, at least a portion of the liner can be formed from a substantially stretchable and resilient fabric material, and wherein one or more other portions of the liner 150 can be formed from substantially inelastic, non-stretchable materials, or for example, semi-stretchable materials or fabrics. In some example forms, it is desirable to provide shape to one or more portions of the internal containment volume S between the different configurations, and thus, some portions of the liner 150 can be provided with the substantially stretchable fabric or other stretchable materials to comprise a desirable deformation (or retraction due to being stretchable) of the liner 50 in either of the bassinet 100' or sleeper configuration.

Optionally, according to some example forms of the invention, the zippered teeth 180, 182 and 184 can be in the form of other interengagement members or couplings, for example, one or more clips, hook and loop (e.g., VELCRO) material, buckles, snaps, ties, hooks, or other releasably engageable members.

Figure 17:
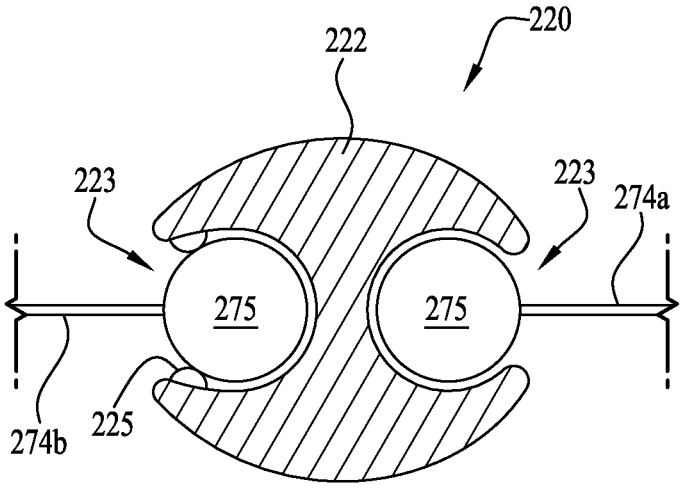
FIG. 17 shows a cross-sectional view of a portion of the support frame of FIG. 16 taken along line 17-17.
Figure 15:
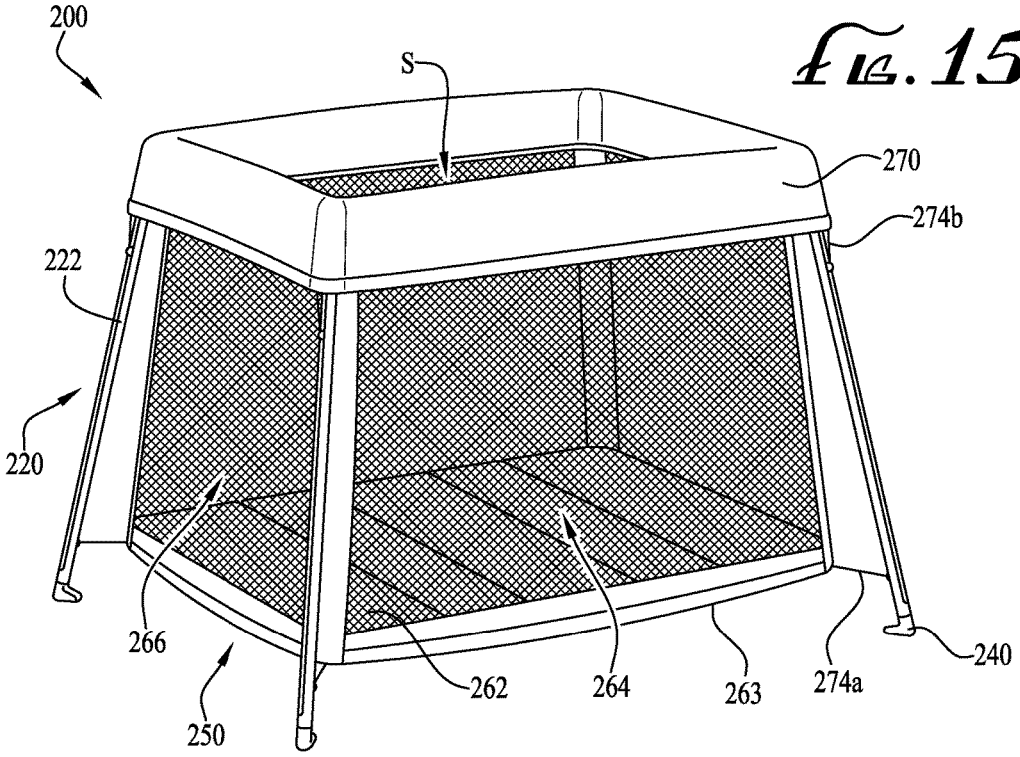
FIG. 15 is a perspective view of a play yard having a depth-adjustable fabric enclosure according to another example embodiment of the present invention, wherein a floor portion of the depth-adjustable fabric is positioned at a first floor position.
Figure 16:
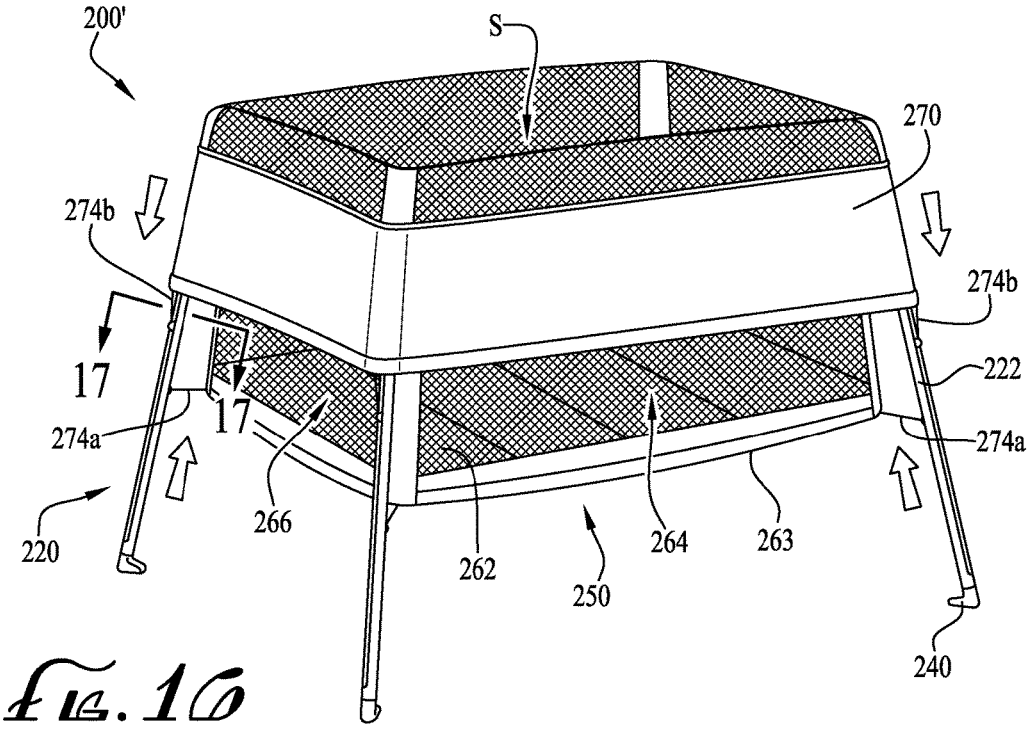
FIG. 16 is a perspective view of the play yard of FIG. 15, showing the depth-adjustable fabric enclosure configured as a bassinet, according to another example embodiment of the present invention, with the floor of the depth-adjustable fabric enclosure positioned at a second floor position.

FIGS. 15-17 show a child containment device according to another example embodiment of the present invention. As depicted, the child containment device can be convertible between a play yard configuration 200, a bassinet configuration 200', and a sleeper configuration (not shown). Preferably, the child containment device is configured such that the height of the mattress 162 can be secured at a plurality of different heights. As depicted, each of the corner posts 222 define two generally spaced-apart channels 223 extending along the length thereof. In example embodiments, a shuttle or slide-rod 275 is generally movably mounted within an outer channel of the channels 223 and connected to the flap portion 270 of the liner 250 by a strap, tether or other connector 174*b*. Similarly, a shuttle or slide-rod 275 is movably mounted within the inner channel of the channels 223 and connected to the floor panel 263 (or a portion of the panels 264, 266). Thus, with the liner 250 engaged with the shuttles 275, and the shuttles 275 engaged with portions of the liner 250, the height of the mattress 262 (or floor panel 263 supporting the mattress 262) can be adjustable between a plurality of different heights. In the play yard configuration 200, the floor panel 263 is at a first floor height and generally in contact with the ground surface. In the bassinet configuration 200', the mattress 262 is generally positioned at a second floor position that is at least partially offset upwardly from the first floor position. And, in the sleeper configuration, the mattress 262 is at a third floor position that is at least partially offset upwardly from the second floor position. Optionally, the height of the mattress 262 can generally be configured as desired, for example, at a height that is generally between the ground surface and an uppermost portion of the corner posts 222. In some example forms, as depicted in FIG. 17, one or more interengagement members 225 can be provided within one or more portions of the channels 223, or can be formed along at least a portion of the extension of the channels 223 such that the shuttles 275 can be frictionally engaged with the channel 223, and thus allow for substantial securement of the mattress 262 at a particular position. Thus, in some example forms, at least portions of the length of the channels 223 can comprise interengagement members 225, which can extend a desirable length, to provide for generally substantially securing the liner 250 (and floor panel 263) at a particular height. In alternative example embodiments, the liner 250 can be secured and positioned between the configurations by use of other fasteners, for example, with clips, hooks, snaps, etc. In some example forms, a plurality of interengagement members or fasteners are provided along the length of both the outer and inner portions (or sides) of the corner posts 222, and wherein portions of the liner 250 comprise interengagement features or fasteners for providing removable coupling engagement with the fasteners of the corner posts 222, for example such that the floor panel 263 can be positioned at a plurality of floor heights.

In example embodiments, as described above, the liner 250 can be substantially stretchable and elastic, substantially inelastic and non-stretchable, or can be a combination of both comprising stretchable, elastic portions and inelastic, non-stretchable portions. For example, according to some example embodiments, when the corner posts 222 extend outwardly (e.g., forming a trapezoidal/pyramid frame), the liner 250 is configured to be at least partially elastic and stretchable, for example, to conform to the shape of the frame 220 in the several configurations. Alternatively, in some example embodiments, when the corner posts 222 are configured for extending substantially vertical (e.g., up and down), the liner 250 can be inelastic and non-stretchable.

Figure 18:
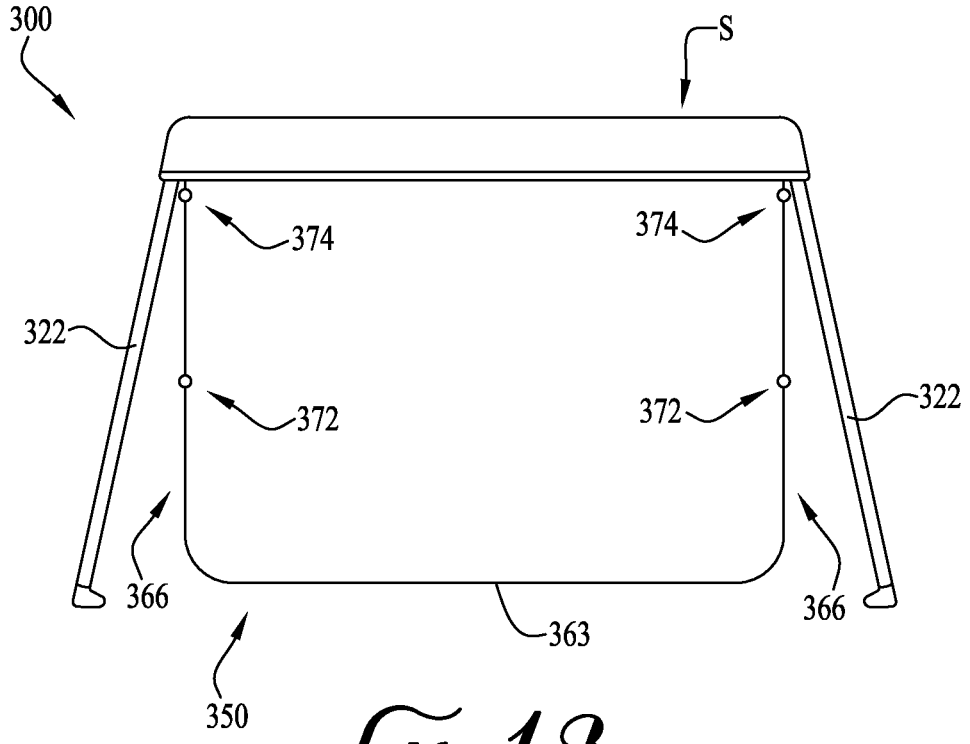
FIG. 18 shows a side plan view of a play yard having a depth-adjustable fabric enclosure according to another example embodiment of the present invention, wherein a floor portion of the depth-adjustable fabric is positioned at a first floor position.
Figure 19:
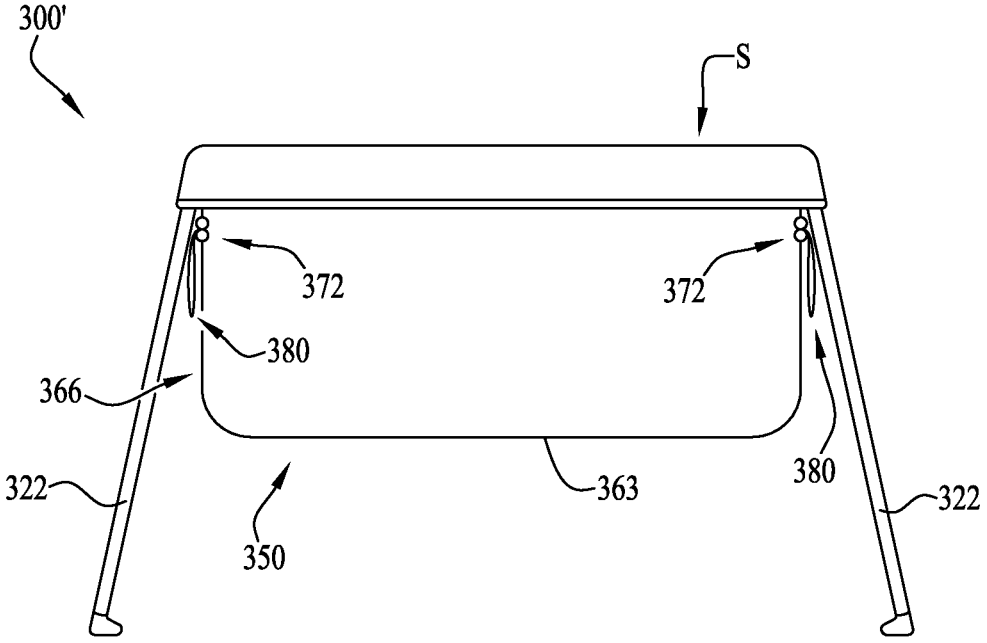
FIG. 19 shows a side plan view of the play yard of FIG. 18, showing the depth-adjustable fabric enclosure configured as a bassinet, according to another example embodiment of the present invention, with the floor of the depth-adjustable fabric enclosure positioned at a second floor position.

FIGS. 18-19 show a show a child containment device according to another example embodiment of the present invention. As depicted, the child containment device can be convertible between a play yard configuration 300, a bassinet configuration 300', and a sleeper configuration (not shown). Preferably, the child containment device is configured such that the height of the mattress 362 (or floor panel 363) can be secured at a plurality of different heights. As depicted, the sidewall enclosure (or panel(s) thereof—depicted as end wall panels 366) comprises a plurality of interengagement members or fasteners 372, 374 for providing removable coupling engagement therebetween, for example, to adjust the height of the floor panel 363 relative to the support surface. As depicted in FIG. 18, the end wall panels 366 of the liner 350 comprise first fasteners 372 generally mounted to an intermediate or middle portion of the panel 366 (e.g., between the floor panel 363 and upper portion), and comprise second fasteners 347 generally mounted to an upper portion of the end wall panels 366. Thus, as shown in FIG. 19, the first and second fasteners 372, 374 are coupled together to provide for adjustment to the height of the floor panel 363, for example, to convert the child containment device from a play yard configuration 300 to a bassinet configuration 300'. In example embodiments, convertibility between the configurations is provided by an accordion-like fold 380 of the liner (the excess fabric is generally resting and hanging on an outer or exterior portion of the liner 350), for example, whereby the first and second fasteners are coupled together to provide adjustment to the height of the floor panel. Preferably, additional fasteners can be provided such that the floor panel 363 can be adjustable between a plurality of heights. Optionally, one or more of the fasteners can be mounted to portions of the frame or corner posts 322, and the accordion-like flap 380 can be configured for hanging interiorly, for example, within the area defining the interior containment volume S. In example embodiments, the liner 350 is substantially inelastic and non-stretchable. Optionally, the liner 350 can be substantially elastic and stretchable, or can be at least partially stretchable as desired.

Figure 20:
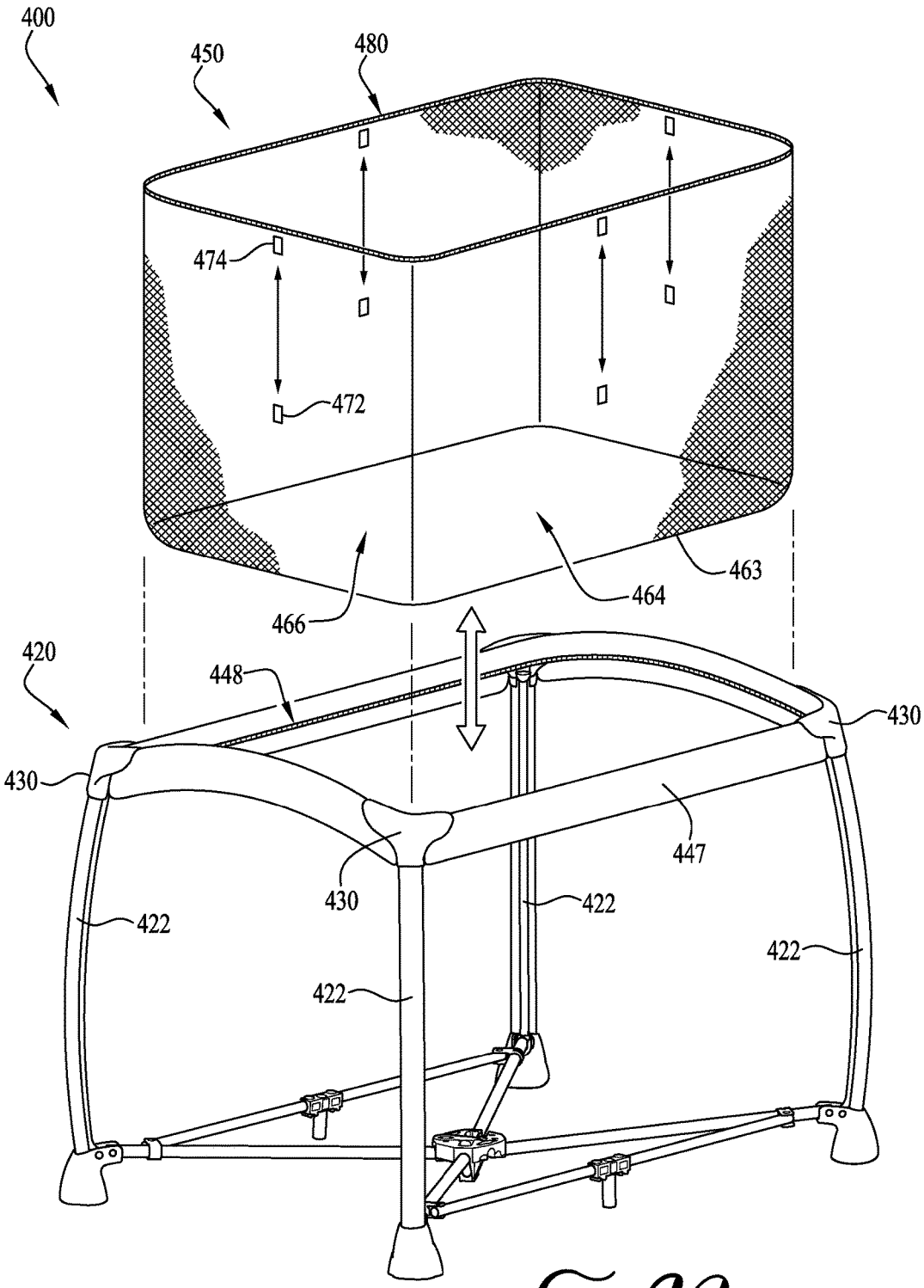
FIG. 20 shows a perspective assembly view of a play yard according to another example embodiment of the present invention, showing a sleeve connected to an upper portion of a structural support frame and having fasteners for coupling engagement with a depth-adjustable fabric enclosure.

FIG. 20 shows a child containment device according to another example embodiment of the present invention. As depicted, the child containment device can be convertible between a play yard configuration 400, a bassinet configuration (not shown), and a sleeper configuration (not shown). Preferably, the child containment device is configured such that the height of the mattress 362 (or floor panel 363) can be secured at a plurality of different heights. As depicted, the sidewall enclosure (or panel(s) thereof—depicted as side and end wall panels 464, 466) comprises a plurality of interengagement members or fasteners 472, 474 for providing removable coupling engagement therebetween, for example, to adjust the height of the floor panel 363 relative to the support surface (as described in FIGS. 18-19). In example embodiments, the structural support frame 420 comprises a sleeve 447 for coupling to the upper side and end cross-members. Preferably, the sleeve 447 comprises a fastener 448 for providing coupling engagement with a fastener 480 of the liner 450, for example, to connect the liner 450 to the structural support frame 420. In example embodiments, the fasteners 448, 480 are generally in the form of zippered teeth, which are interengageable with each other and generally extend around the entire perimeter of the respective sleeve 447 and sidewall enclosure of the liner 450. In example embodiments, the sleeve 447 can be formed to extend around the entire upper perimeter of the support frame, or for example, can comprise individual sleeves for connecting to each of the upper cross-members. The sleeve 447 can be permanently mounted to the cross-members, or the sleeve can be removably attached thereto to provide for removal therefrom. Similarly, the fasteners 447, 480 can be configured for permanent or removable engagement therebetween. In alternate embodiments, the fasteners for securing the liner 450 to the frame (e.g., fasteners 447, 480) and the fasteners of the liner 450 for providing adjustment to the height of the floor panel 463 (e.g., 472, 474) can be in other forms, for example, other mating fasteners including clips, hooks, snaps, or other interengagement members as desired. In example embodiments, the liner 450 is substantially inelastic and non-stretchable. Optionally, the liner 450 can be substantially elastic and stretchable, or can be at least partially stretchable as desired.

While the invention has been described with reference to preferred and example embodiments, it will be understood by those skilled in the art that a variety of modifications, additions and deletions are within the scope of the invention, as defined by the following claims.

What is claimed is:

1. A child containment device comprising:

a structural support frame comprising a plurality of corner posts and a plurality of cross-members extending between the corner posts; and a liner removably attached to the structural support frame, the liner comprising a sidewall enclosure extending between the corner posts of the frame and a floor panel engaged with the sidewall enclosure, the sidewall enclosure and the floor panel generally defining an internal containment volume, and wherein the child containment device is convertible between two or more configurations in which the floor panel is positioned at two or more respective heights, wherein an upper portion of the liner comprises a flap portion integrally connected to and foldable relative to the liner, the flap portion being in the form of one or more extensions of the sidewall enclosure for folding around at least a portion of the structural support frame, and wherein convertibility between the two or more configurations is provided by one or more folds of the upper flap portion around at least a portion of the structural support frame that reduces the allowable extension of the sidewall enclosure and thus raises the height of the floor panel height.

2. The child containment device of claim 1, wherein the two or more configurations include at least two of a play yard configuration, a bassinet configuration, and a sleeper configuration.

3. The child containment device of claim 2, wherein in the play yard configuration, the floor panel of the liner is positioned at a first floor position.

4. The child containment device of claim 2, wherein in the bassinet configuration, the floor panel of the liner is positioned at a second floor position.

5. The child containment device of claim 2, wherein in the sleeper configuration, the floor panel of the liner is positioned at a third floor position.

6. The child containment device of claim 1, wherein the sidewall enclosure comprises side and end wall panels.

7. The child containment device of claim 1, wherein the liner is formed from a single piece of fabric.

8. The child containment device of claim 1, wherein the liner is substantially stretchable and resilient.

9. The child containment device of claim 1, wherein the liner is formed from two or more pieces of fabric.

10. The child containment device of claim 1, wherein the convertibility between the two or more configurations is provided by an accordion-like fold of the liner to provide adjustment to the height of the floor panel.

11. The child containment device of claim 10, wherein fasteners are provided for removable engagement of the liner with itself such that the height of the floor is adjustable.

12. The child containment device of claim 1, further comprising one or more fastening members provided generally near the floor panel for removable attachment to portions of the corner posts, wherein convertibility between the two or more configurations is provided by moving the position of attachment of the fastening members with the corner posts.

13. The child containment device of claim 1, further comprising a mattress for fitting engagement within the liner and generally in contact with the floor panel.

14. The child containment device of claim 13, wherein the mattress generally comprises one or more foldable panels or segments.

15. The child containment device of claim 14, wherein the mattress can be folded or repositioned within the liner to against the floor panel to accommodate fitting engagement with the liner in one or more of the configurations.

16. A child containment device comprising a structural frame and a depth-adjustable fabric enclosure connected to the structural frame, the structural frame comprising a plurality of corner posts and a plurality of cross-members extending between the corner posts, and the depth-adjustable fabric enclosure comprising a sidewall enclosure, a flap portion, and a floor panel, wherein the floor panel of the depth-adjustable fabric enclosure is positioned between two or more heights to define two or more configurations of the child containment device by extending the flap portion around an upper portion of the structural frame.

* * * * *